252/100

United States Patent [19]

Niven et al.

[11] Patent Number: 4,645,616

[45] Date of Patent: Feb. 24, 1987

[54] DETERGENT POWDERS AND PROCESSES FOR PRODUCING THEM

[75] Inventors: Ian E. Niven, Liverpool; Andrew W. Travill, Wirral, both of England

[73] Assignee: Lever Brothers Company, New York, N.Y.

[21] Appl. No.: 793,469

[22] Filed: Oct. 31, 1985

Related U.S. Application Data

[63] Continuation of Ser. No. 660,622, Oct. 15, 1984, abandoned.

[30] Foreign Application Priority Data

Oct. 19, 1983 [GB] United Kingdom ..... 8328017

[51] Int. Cl.[4] ..... C11D 3/12; C11D 7/20

[52] U.S. Cl. ..... 252/135; 252/100; 252/136; 252/142; 252/145; 252/174.17; 252/174.23; 252/174.24; 252/DIG. 2

[58] Field of Search ..... 252/100, 135, 136, 142, 252/145, 174.17, 174.23, 174.24, DIG. 2

[56] References Cited

U.S. PATENT DOCUMENTS

| | | | |
|---|---|---|---|
| 3,708,428 | 1/1973 | McDonald | 252/109 |
| 3,721,627 | 3/1973 | Adams et al. | 252/174.24 |
| 4,007,124 | 2/1977 | Collier et al. | 252/109 |

FOREIGN PATENT DOCUMENTS

| | | |
|---|---|---|
| 54-106509 | 8/1979 | Japan . |
| 0943405 | 12/1963 | United Kingdom . |
| 1429143 | 3/1976 | United Kingdom . |
| 1473201 | 5/1977 | United Kingdom . |
| 1473202 | 5/1977 | United Kingdom . |

*Primary Examiner*—Paul Lieberman
*Assistant Examiner*—Hoa Van Le
*Attorney, Agent, or Firm*—Gerard J. McGowan, Jr.; James J. Farrell

[57] ABSTRACT

The formation of poorly-dispersible material by interaction between sodium silicate and sodium aluminosilicate in a detergent powder can be reduced by acidification of the slurry prior to spray-drying. An acid in an amount equivalent to from 1.5 to 3 parts by weight of hydrogen chloride per 6 parts of sodium silicate of sodium oxide to silica ratio 1 to 1.6 is added to precipitate at least part of the silicate. Optionally, a powder-structurant is present.

10 Claims, No Drawings

DETERGENT POWDERS AND PROCESSES FOR PRODUCING THEM

This is a continuation application of Ser. No. 660,622, filed Oct. 15, 1984, now abandoned.

This invention relates to detergent powders and to a process for preparing them.

Most detergent powders contain sodium silicate. Sodium silicate has two functions in a detergent powder: first it is an excellent inhibitor of corrosion of aluminium and to some extent of vitreous enamel and secondly it is capable of enhancing the physical structure of a powder, although when there is a high content of sodium tripolyphosphate present this latter property will be masked.

There is now a tendency towards replacement of phosphate builder salts by aluminosilicates (zeolites). While the loss of structuring capacity caused by omission of phosphate salts would not appear to be a problem, in that sodium silicate could equally well perform the structurant function, the incorporation of sodium silicate and aluminosilicate under normal processing conditions results in the powder exhibiting a high level of insoluble or non-dispersible material on addition to water. Consequently, substitution of phosphate salts by aluminosilicates re-introduces the problem of how to obtain the desired corrosion inhibition and powder structuring without encountering difficulties with high levels of insoluble or non-dispersible substances.

We have now discovered how to prepare an aluminosilicate based powder which has satisfactory structure, corrosion characteristics and good solubility both initially and on storage.

Accordingly, the present invention provides a process for manufacturing a detergent powder which comprises forming an aqueous crutcher slurry comprising a surfactant system, a sodium aluminosilicate detergency builder and sodium silicate, adding an acid to the slurry in an amount equivalent to 1.5–3 parts, preferably 1.9–2.5 parts, by weight of hydrogen chloride per 6 parts of sodium silicate of sodium oxide to silica ratio 1:1.6, and precipitating at least part of the sodium silicate;

adjusting the pH of the slurry if necessary, and spray drying it.

From 1.9 to 2.1 parts by weight of acid, expressed on the above basis, have been found to be especially effective.

We are aware of U.S. Pat. No. 4,007,124 (Procter & Gamble). This is concerned with detergent compositions containing sodium silicate and sodium pyrophosphate, it having been found that the former interferes with the precipitant builder function of the latter. This interference can be reduced by pre-treatment of the silicate with acid before its incorporation into the crutcher slurry. In contrast, the process of the present invention is not concerned with silicate/pyrophosphate interactions or with pre-treatment.

We are also aware of Japanese patent application 54 106509 (Lion Fat and Oil Co) which relates to a process in which a slurry precursor containing an acidified sodium silicate is prepared. However, this specificaton is not concerned with manufacture of powders containing sodium aluminosilicates.

Mineral acids such as sulphuric acid or hydrochloric acid, organic acids such as citric acid, succinic acid, glutaric acid or adipic acid, partially neutralised salts of either type of material, or mixtures thereof may be used as the acids in the process of this invention. In addition, if unneutralised fatty acid is added to the slurry, it may serve as the acidification agent, neutralisation taking place at a later stage.

The amount of acid necessary will be dependent upon the molecular weight of the acid itself, and the amount and alkalinity of the sodium silicate in the formulation. For this reason the amount required is expressed as an amount equivalent to 1.5–2.5 parts of hydrogen chloride for every 6 parts of sodium silicate having a sodium oxide to silica ratio of 1 to 1.6. Sodium silicate containing greater amounts of sodium oxide will require greater amounts of acid and vice versa. The amount of acid added is determined in general by balancing two factors: if too little acid is added the amount of insoluble or poorly-dispersible material generated on storage rises, and if too much is added corrosion protection is obtained only at higher dosages.

The surfactant system will include an anionic surfactant and/or soap, a nonionic surfactant or a mixture of these. Typical amounts of such surfactants are from 2 to 30% by weight based on the weight of the spray-dried powder of the anionic surfactant or soap or mixtures thereof when these are used alone, from 2 to 20% by weight of nonionic surfactant when used alone and, when a binary mixture of anionic surfactant and nonionic surfactant is used, from 2 to 25% by weight of anionic surfactant and from 0.5 to 20% by weight of nonionic surfactant. Such binary mixtures can be either anionic rich or nonionic rich. When a so-called ternary mixture of anionic surfactant, nonionic surfactant and soap is used, preferred amounts of the individual components of the mixture are from 2 to 15% by weight of anionic surfactant, from 0.5 to 7.5% by weight of nonionic surfactant, and from 1 to 15% by weight of soap.

Examples of anionic surfactants which can be used are alkyl benzene sulphonates, particularly sodium alkyl benzene sulphonates having an average alkyl chain length of $C_{12}$; primary and secondary alcohol sulphates, particularly sodium $C_{12}$–$C_{15}$ primary alcohol sulphates, olefine sulphonates and alkane sulphonates.

The soaps which can be used are preferably sodium soaps derived from naturally-occurring fatty acids, preferably fatty acids from coconut oil, tallow or one of the oils high in unsaturated acids such as sunflower oil.

The nonionic surfactants which can be used are the primary and secondary alcohol ethoxylates, especially the $C_{12}$–$C_{15}$ primary and secondary alcohols ethoxylated with from 5 to 20 moles of ethylene oxide per mole of alcohol.

The aluminosilicates used in the invention will normally be sodium aluminosilicates and may be crystalline or amorphous, or a mixture thereof. They will normally contain some bound water and will normally have a calcium ion-exchange capacity of at least about 50 mg CaO/g. The preferred aluminosilicates have the general formula:

$$0.8 \rightarrow 1.5 Na_2O.Al_2O_3.0.8 \rightarrow 6 SiO_2$$

Most preferably they contain 1.5–3.5 $SiO_2$ units in the formula above and have a particle size of not more than about 100μ, preferably not more than about 20μ.

Suitable amorphous sodium aluminosilicates for detergency building use are described for example in British Patent Specification No 1 473 202. Use of the process of the invention for making detergent compositions containing such sodium aluminosilicates helps particularly to increase their rate of calcium ion-exchange, which is an important benefit in the detergent process.

Alternatively, suitable crystalline sodium aluminosilicate ion-exchange detergency builders are described in UK Patent Specifications Nos 1 473 201 and 1 429 143. The preferred sodium aluminosilicates of this type are the well known commercially-available zeolites A and X, and mixtures thereof. The ion-exchange properties of the crystalline aluminosilicates are not seriously affected by contact with sodium silicate, but the latter appears to promote aggregation of the sodium aluminosilicate particles which is seen by the consumer as decreased solubility of the compositions and sometimes deposition on the washed fabrics.

The precipitation of the silicate which is what is achieved in the process of this invention is pH dependent, and the precise pH at which it occurs will vary with the formulation, generally within the range 9 to 10. In order to maintain the slurry pH, or even the pH of the wash liquor solution, it is advantageous to incorporate small amounts buffers, into the formulation.

While in many instances the formulation which is subjected to acidification will retain sufficient amounts of silicate (or other materials having a similar effect) in solution to result in the spray-dried powder produced having an adequate structure, it may often be necessary to employ a powder structurant. The powder structurants most suitable for use in this invention are first, sodium succinate or the commercial mixture of succinic, adipic and glutaric acids sold by BASF GmbH, West Germany as Sokalan DCS (Registered Trade Mark) the sodium salt of which acts as a structurant, film-forming polymers of either natural or synthetic origin such as starches, ethylene/maleic anhydride copolymers, polyvinyl pyrrolidone, polyacrylates and cellulose ether derivatives such as Natrosol 250 MHR (trade mark) and inorganic polymers such as clays and borates of various types. These materials will be present in an amount sufficient to structure the powder, generally from about 0.5 to about 10% by weight of the spray-dried powder, most preferably 3 to 6% by weight.

Sodium silicate is an essential component of the powders of the invention since without it, or its precipitated form which we believe to be substantially equivalent to silica, the wash liquor containing the powders produces corrosion of vitreous enamel and/or aluminium machine parts. It will generally be present in amounts of up to 15% or even 20% by weight of the spray-dried powder.

In addition to sodium aluminosilicate the usual organic and inorganic builders and co-builders may be used. These include, but are not restricted to, sodium tripolyphosphate, sodium pyrophosphate and sodium orthophosphate, sodium nitrilotriacetate, sodium carboxymethyloxysuccinate and mixtures thereof.

Other components of detergent powders which may optionally be present include lather controllers, anti-redeposition agents, oxygen and chlorine bleaches, fabric softening agents, perfumes, germicides colourants and fluorescers.

The invention will be further described in the following examples.

EXAMPLES 1 AND 2

In Example 1 four ternary active powders A–D and in Example 2 four binary powders E–H having the formulations shown in Table 1 were prepared by slurry-making and spray-drying.

The physical properties of the powders—the bulk density, dynamic flow rate, compressibility and the unconfined compression test yield value were then measured using standard methods. Additionally the percentage of insoluble matter remaining on dissolution in water was measured at three different temperatures using a filtration technique. The results are shown in Table 2.

A number of conclusions can be drawn from these tables. Powder A, which does not contain silicate is poorly structured, as shown by its high compressibility. Powders B and E contain silicate and are well structured, but there is a pronounced interaction between the silicate and the zeolite, producing a high level of insolubles. Powder C contains finely-divided silica instead of silicate as an aluminium corrosion inhibitor and consequently the level of insolubles is low but the powder is poorly structured. Powder D, which is a powder in accordance with the invention, contains silicate as a corrosion inhibitor, together with 5 parts by weight (acid basis) of a partially neutralised mixture of succinic, glutaric and adipic acids.

Powder F was prepared by the acidification route, but without a structurant and is readily dispersible but has poor structure. Powders G and H, containing silicate, an acid and a structurant, which are powders in accordance with the invention demonstrate low compressibility, a low level of insolubles and also produce a low level of corrosion on aluminium.

TABLE 1

| | Parts by Weight | | | | | | | |
|---|---|---|---|---|---|---|---|---|
| | Example 1 | | | | Example 2 | | | |
| Component | A | B | C | D | E | F | G | H |
| Sodium $C_{12}$ alkyl benzene sulphonate | 6.5 | → | → | → | 6.0 | → | → | → |
| Nonionic surfactant | 3.0 | → | → | → | 1.5 | → | → | → |
| Sodium soap | 5.0 | → | → | → | Nil | Nil | Nil | Nil |
| Sodium aluminosilicate (Zeolite) | 40.0 | → | → | → | 21.0 | → | → | → |
| Sodium sulphate | 16.5 | 10.5 | 12.9 | 10.5 | 15.2 | 15.2 | 15.3 | 10.2 |
| Sodium carboxymethyl cellulose | 0.6 | → | → | → | → | → | → | → |
| Ethylene diamine tetraacetic acid | 0.2 | → | → | → | → | → | → | → |
| Fluorescer | 0.2 | → | → | → | → | → | → | → |
| Sodium silicate $Na_2O$:1.6 $SiO_2$ | Nil | 6.0 | Nil | 6.0 | 6.0 | 6.0 | Nil | 6.0 |
| Sodium silicate $Na_2O$:3.3 $SiO_2$ | Nil | Nil | Nil | Nil | Nil | Nil | 4.8 | Nil |
| *Sokalan DCS (acid basis) | Nil | Nil | Nil | 5.0 | Nil | Nil | Nil | 5.0 |
| +Natrosol 250 MHR | Nil | Nil | Nil | Nil | Nil | Nil | 0.6 | Nil |
| Sulphuric acid | Nil | Nil | Nil | Nil | Nil | Nil | 0.5 | Nil |
| **Silica | Nil | Nil | 3.6 | Nil | Nil | Nil | Nil | Nil |
| Water | 11.0 | 11.0 | 11.0 | 11.0 | 5.0 | 5.0 | 5.0 | 5.0 |
| TOTAL | 83.0 | 83.0 | 1 83.0 | 83.0 | 55.7 | 57.5 | 55.7 | 55.7 |

TABLE 1-continued

| Component | Parts by Weight | | | | | | | |
|---|---|---|---|---|---|---|---|---|
| | Example 1 | | | | Example 2 | | | |
| | A | B | C | D | E | F | G | H |
| Acid equivs of HCl (parts w/w) added to 6 parts $Na_2O$:1.6 $SiO_2$ | Nil | Nil | Nil | 2.1 | Nil | 1.8 | 1.8 | 2.1 |

*(Trade Mark) A commercial mixture of succinic, glutaric and adipic acids. 3.7 parts in the acid form, the remainder neutralized with sodium hydroxide.
'(Trade Mark) A cellulose ether derivative
**High surface area precipitated silica

TABLE 2

| Powder | A | B | C | D | E | F | G | H |
|---|---|---|---|---|---|---|---|---|
| Bulk Density (g/l) | 258 | 374 | 224 | 432 | 350 | 304 | 418 | 404 |
| Dynamic Flow Rate (ml/sec) | 114 | 100 | 90 | 100 | 80 | 104 | 83 | 100 |
| Compressibility (% v/v) | 55 | 22 | 52 | 13 | 16 | 45 | 22 | 22 |
| Unconfined Compression Test Yield (Kg) | 3.1 | <0.05 | — | <0.05 | <0.05 | — | 0.15 | <0.05 |
| % Insolubles (w/w) after Weathering | | | | | | | | |
| Water temperature | | | | | | | | |
| 20° C. | 19.6 | 25 | 10.9 | 0.5 | 20 | 8.5 | 9.2 | 3.4 |
| 40° C. | 0.3 | 26 | 2.0 | 0.6 | 15 | 8.4 | 9.0 | 3.1 |
| 60° C. | 0.2 | 25 | 2.1 | — | 10 | 8.8 | 4.3 | 2.5 |

EXAMPLE 3

Four ternary active powders (J–M) containing sodium aluminosilicate and sodium nitilotriacetate having the formulations shown in Table 3 were prepared by slurry making and spray-drying. As in Examples 1 and 2, the physical properties of the powders were then measured, although in this instance the unconfined compression test yield value was not measured. The results are shown in Table 4.

TABLE 3

| | Parts by Weight | | | |
|---|---|---|---|---|
| | J | K | L | M |
| Sodium $C_{12}$ alkyl benzene sulphonate | 6.5 | → | → | → |
| Nonionic surfactant | 3.0 | → | → | → |
| Sodium soap | 5.0 | → | → | → |
| Sodium aluminosilicate | 30.0 | → | → | → |
| Sodium nitrilotriacetate | 10.0 | → | → | → |
| Sodium silicate ($Na_2O$:$S_1O_2$, 1:1.6) | 6.0 | → | → | → |
| Sodium sulphate | 12.5 | 7.3 | 7.0 | 7.0 |
| *Sokalan DCS (acid basis) | Nil | 5.2[a] | 5.0[b] | 5.0[c] |
| Water and minor compounds | 10.0 | 10.0 | 10.0 | 10.0 |
| Acid equivs of HCl (parts w/w) added to 6 parts $Na_2O$:1.6 $SiO_2$ | Nil | 2.87 | 2.0 | 1.9 |
| TOTAL | 83 | 83 | 82.5 | 82.5 |

TABLE 4

| Physical Properties | J | K | L | M |
|---|---|---|---|---|
| Bulk density (g/l) | 390 | 460 | 438 | 386 |
| Dynamic Flow Rate (ml/sec) | 80 | 90 | 120 | 89 |
| Compressibility (% v/v) | 30 | 11 | 12 | 22 |
| Insolubles (% w/w) after weathering | | | | |
| Water temperature | | | | |
| 20° C. | 40 | 5.6 | 2.9 | 5.2 |
| 40° C. | 30 | 3.7 | 0.3 | 3.5 |
| 60° C. | 30 | 1.0 | 0.3 | 0.1 |

*See Table 1
[a]in acid form
[b]3.6 pts w/w in acid form, remainder neutralised by addition of NaOH
[c]3.4 pts w/w in acid form, remainder neutralised by addition of NaOH It can be seen that the percentage of insoluble material produced by Powder J, the control, and also its compressibility, is significantly higher than in the case of Powders K, L or M, which are in accordance with the invention.

EXAMPLE 4

Three further powders having the formulations shown in Table 5 were prepared by a process in accordance with the invention, the physical properties of the powders obtained being shown in Table 6.

TABLE 5

| | Parts by weight | | |
|---|---|---|---|
| | P | Q | R |
| Sodium $C_{12}$ alkyl benzene sulphonate | 6 | 6 | 6.3 |
| Nonionic surfactant | 1.5 | 1.5 | 3.0 |
| Sodium soap | — | — | 5.0 |
| Sodium aluminosilicate | 21 | 21 | 30 |
| Sodium silicate ($Na_2O$:1.6 $SiO_2$) | | 12 | 6 |
| Sodium silicate ($Na_2O$:3.3 $SiO_2$) | 7.5 | — | — |
| Sodium nitrilotriacetate | — | — | 10 |
| Sodium orthophosphate | — | — | — |
| Sulphuric acid | 1.2 | — | — |
| *Sokalan DCS (acid basis) | — | — | 5 |
| [30] Natrosol 250 MHR | 0.6 | — | — |
| Water | 17.9 | 15.2 | 17.2 |
| Acid equivs of HCl (parts w/w) added to 6 parts $Na_2O$:1.6 $SiO_2$ | 2.0 | 2.0 | 2.0 |

*+ See Table 1

TABLE 6

| Powder | P | Q | R |
|---|---|---|---|
| Bulk density (g/l) | 351 | 448 | 354 |
| Dynamic flow rate (ml/sec) | 96 | 100 | 109 |
| Compressibility (% v/v) | 33 | 15 | 23 |
| % Insolubles (w/w) after weathering | | | |
| Water temperature | | | |
| 20° C. | 15 | 14 | 1.1 |
| 40° C. | 1.9 | 13 | 16 |
| 60° C. | ND* | ND* | 0.5 |

*Not determined.

We claim:

1. A process of manufacture of a detergent powder which comprises the steps of (i) forming an aqueous crutcher slurry comprising a surfactant, a sodium aluminosilicate detergency builder and sodium silicate;

(ii) adding an acid to the slurry in an amount equivalent to from 1.5 to 3 parts by weight of hydrogen chloride per 6 parts of sodium silicate having a sodium oxide to silica ratio of 1 to 1.6, and precipitating at least part of the sodium silicate;

(iii) spray-drying the slurry to form a powder.

2. A process according to claim 1 wherein the amount of acid added is from 1.9 to 2.5 parts by weight on the basis defined in claim 1.

3. A process according to claim 2 wherein the amount of acid added is from 1.9 to 2.1 parts by weight on the basis defined in claim 1.

4. A process according to any one of the preceding claims wherein the pH is adjusted to a value of from about 9 to 10 at a concentration of 10 g/l.

5. A process according to claim 4 wherein the pH is adjusted to a value of about 9.

6. A process according to claim 1 or 2 or 3 wherein the acid comprises a mineral acid, or an organic acid, a partially neutralised salt thereof or a mixture thereof.

7. A process according to claim 1 or 2 or 3 wherein the aqueous crutcher slurry comprises a powder structurant.

8. A process according to claim 7 wherein the structurant comprises a dibasic acid, a starch or cellulose, a synthetic organic polymer, a clay, a borate or a mixture thereof.

9. A process according to claim 8 wherein the dibasic acid comprises succinic acid, adipic acid, glutaric acid or a salt thereof, or a mixture thereof.

10. A process according to claim 9 wherein the synthetic organic polymer comprises an ethylene/maleic anhydride copolymer, a polyvinylpyrrolidone or a polyacrylate.

* * * * *